US007513752B2

(12) United States Patent
Boone et al.

(10) Patent No.: US 7,513,752 B2
(45) Date of Patent: Apr. 7, 2009

(54) BEAM PUMP DYNAMIC LOAD MONITORING AND METHODS

(75) Inventors: Douglas M. Boone, Parker, CO (US); Philip R. Couch, Honiton (GB); Robert M. Harman, Troutville, VA (US)

(73) Assignee: FBiMonitoring, Inc., Tyler, TX (US)

( * ) Notice: Subject to any disclaimer, the term of this patent is extended or adjusted under 35 U.S.C. 154(b) by 621 days.

(21) Appl. No.: 10/934,307

(22) Filed: Sep. 3, 2004

(65) Prior Publication Data

US 2005/0089425 A1 Apr. 28, 2005

Related U.S. Application Data

(60) Provisional application No. 60/499,721, filed on Sep. 4, 2003.

(51) Int. Cl.

| | |
|---|---|
| ***E21B 29/02*** | (2006.01) |
| ***E21B 49/00*** | (2006.01) |
| ***G01H 13/00*** | (2006.01) |
| ***F04B 49/00*** | (2006.01) |

(52) U.S. Cl. ..... 417/44.1; 417/53; 417/63; 166/66; 166/250.1; 73/152.01; 73/581

(58) Field of Classification Search ..... 417/18, 417/22, 44, 53, 63; 166/250.1, 68, 66; 73/151, 73/152, 152.5, 581, 597

See application file for complete search history.

(56) References Cited

U.S. PATENT DOCUMENTS

| | | | | | |
|---|---|---|---|---|---|
| 3,838,597 | A * | 10/1974 | Montgomery et al. | .... | 73/152.61 |
| 3,965,736 | A * | 6/1976 | Welton et al. | ..... | 73/152.61 |
| 4,090,405 | A * | 5/1978 | McKee | ..... | 73/152.61 |
| 4,208,665 | A * | 6/1980 | Mills | ..... | 346/33 WL |
| 4,363,605 | A * | 12/1982 | Mills | ..... | 417/44.11 |
| 4,543,837 | A * | 10/1985 | Stern et al. | ..... | 73/862.623 |
| 5,064,349 | A * | 11/1991 | Turner et al. | ..... | 417/53 |
| 5,182,946 | A * | 2/1993 | Boughner et al. | ..... | 73/152.62 |
| 5,336,854 | A * | 8/1994 | Johnson | ..... | 177/210 FP |
| 5,464,058 | A * | 11/1995 | McCoy et al. | ..... | 166/250.01 |
| 6,546,806 | B1 * | 4/2003 | Varma | ..... | 73/775 |
| 7,032,659 | B2 * | 4/2006 | Barnes et al. | ..... | 166/66 |

* cited by examiner

*Primary Examiner*—Charles G Freay
(74) *Attorney, Agent, or Firm*—Mueller Smith & Okuley

(57) ABSTRACT

A pump monitoring system includes a monitoring device configured for attachment to a cable harness of a pump, a strain gauge configured to measure dynamic loading of at least one cable of the cable harness as the pump operates, a wireless transmitter configured to transmit the dynamic loading measurement, and an external device configured to receive the transmitted dynamic loading measurement.

15 Claims, 4 Drawing Sheets

BEAM PUMP DYNAMIC LOAD MONITORING AND METHODS

CROSS-REFERENCES TO RELATED APPLICATIONS

This application is a non-provisional of, and claims the benefit of, U.S. Provisional Application No. 60/499,721, entitled "BEAM PUMP DYNAMIC LOAD MONITORING," filed on Sep. 4, 2003, by Philip R. Couch, et al., the entire disclosure of which is herein incorporated by reference for all purposes.

BACKGROUND OF THE INVENTION

Embodiments of the present invention relate generally pumping systems. More specifically, embodiments of the invention relate to systems and methods for monitoring dynamic loading of beam pumps.

Oil frequently is extracted from the ground using a beam pump. The dynamic stress on the rod connecting the oscillating beam, down the well to the lifting pump, can provide much information about the health and status of the pump. Stress on this rod is frequently measured by one or more strain gauges on the rod or on the beam. One example of such a system is described in U.S. Pat. No. 5,464,058, the entire disclosure of which is herein incorporated by reference. A difficulty with these measurement techniques is the temperature sensitivity of the materials to which the device is attached and how this affects the small signal measured by a strain gauge. Embodiment of the present invention address this and other issues.

BRIEF SUMMARY OF THE INVENTION

Embodiments of the invention thus provide a pump monitoring system. The system includes a monitoring device configured for attachment to a cable harness of a pump. The monitoring device has a strain gauge configured to measure dynamic loading of at least one cable of the cable harness as the pump operates. The monitoring device also includes a wireless transmitter configured to transmit the dynamic loading measurement. The system also includes an external device configured to receive the transmitted dynamic loading measurement.

In some embodiments, the external device is a monitoring location. The external device may be a motor controller configured to adjust a pumping frequency of the pump in relation to the dynamic loading measurement. The monitoring device may include a solar cell configured to power the device. The monitoring device may include a battery configured to power the device. The monitoring device may be configured for attachment to two cables of the cable harness at an attachment point such that the device is positioned to measure a horizontal restoring force tending to separate the cables from one another at the attachment point as the cables are tensioned in the vertical direction.

In still other embodiments, a monitoring device includes means for attaching the device to an attachment point of a cable harness of a beam pump, means for measuring dynamic loading of at least one cable of the cable harness as the pump operates, means for powering the measuring means, and means for transmitting the dynamic loading measurement to a different location. The powering means may be a solar cell and/or a battery. The transmitting means may be a wireless transmitter. The measuring means may be a strain gauge. The attaching means may be a threaded member and an opposing member such that the device may be placed around two cables of the cable harness and attached so as to measure a horizontal restoring force tending to separate the cables from one another at the attachment point as the cables are tensioned in the vertical direction. The different location may be a location proximate a motor controller of the pump.

In further embodiments of the invention, a method of monitoring dynamic loading in a beam pump includes attaching a monitoring device to an attachment point of a cable harness connecting a pump rod to the pump, measuring the stress in at least one cable of the cable harness induced at the attachment point by operation of the pump, and transmitting the measurement to a different location. Attaching a monitoring device to an attachment point of a cable harness may include attaching the device to two cables of the cable harness such that the device is positioned to measure a horizontal restoring force tending to separate the cables from one another at the attachment point as the cables are tensioned in the vertical direction. Attaching a monitoring device to an attachment point of a cable harness may include attaching the device to a single cable of the cable harness. The different location may be a location proximate a motor controller of the pump in which case the method may include using the measurement to adjust a pumping frequency of the pump.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

According to embodiments of the present invention, a beam pump dynamic loading monitoring device is attached to a cable harness of the device. In some embodiments, the device is attached to two cables of the harness; in other embodiment it is attached to only one cable. Herein, "two cables" will be understood to include "two different portions of the same cable." Some embodiments of the monitoring device are attached noninvasively and without the need for a separate power supply. The device also may be attached at a point on the pump where temperature changes do not alter measurements. Embodiments of the device include power supplies, such as solar cells and/or batteries. Some embodiments also include wireless transmitters so that the device may be installed in the field and monitored remotely.

Figure 1A:
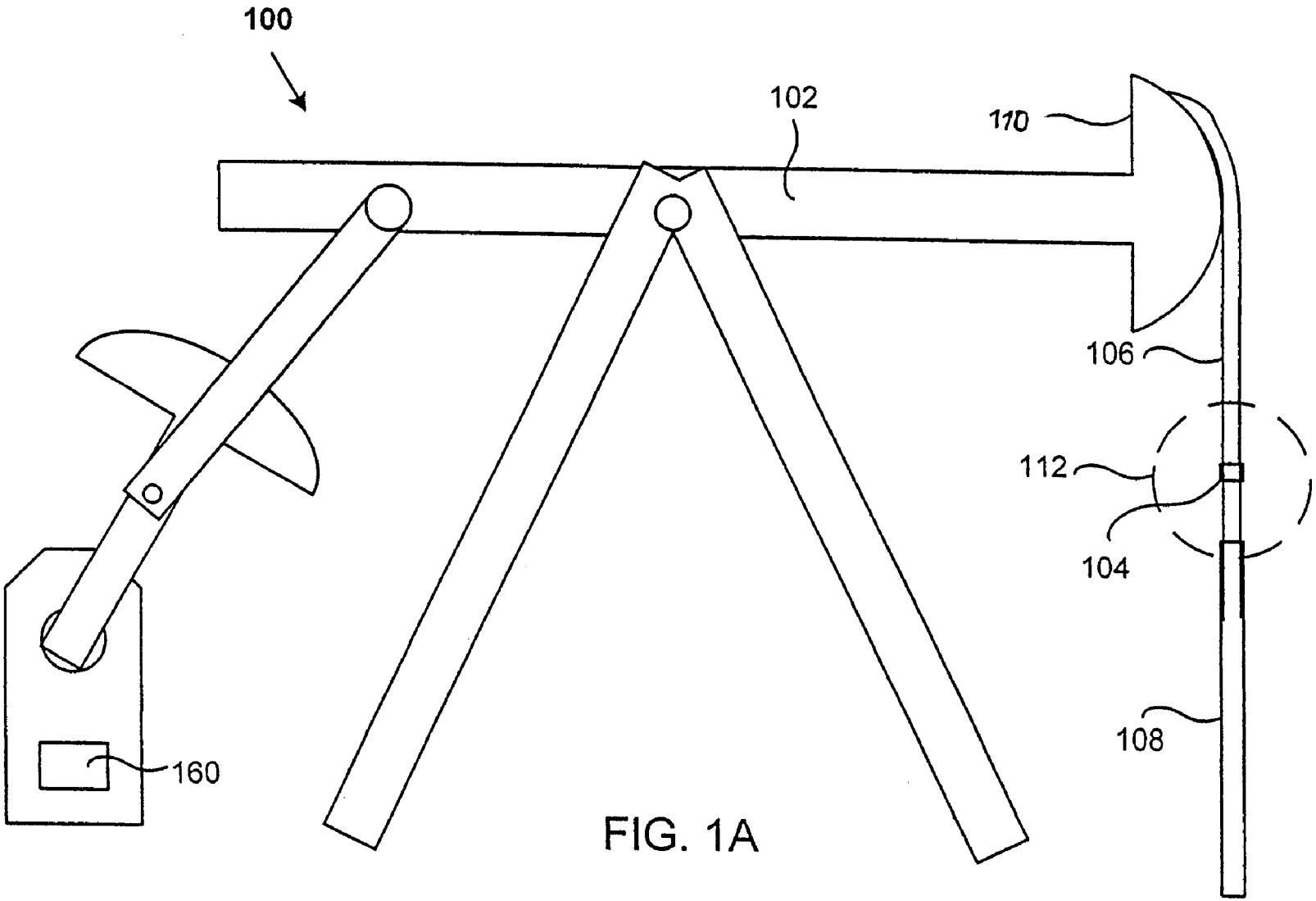
FIG. 1A illustrates a beam pump having a dynamic loading monitoring device attached thereto according to embodiment of the invention.
Figure 1B:
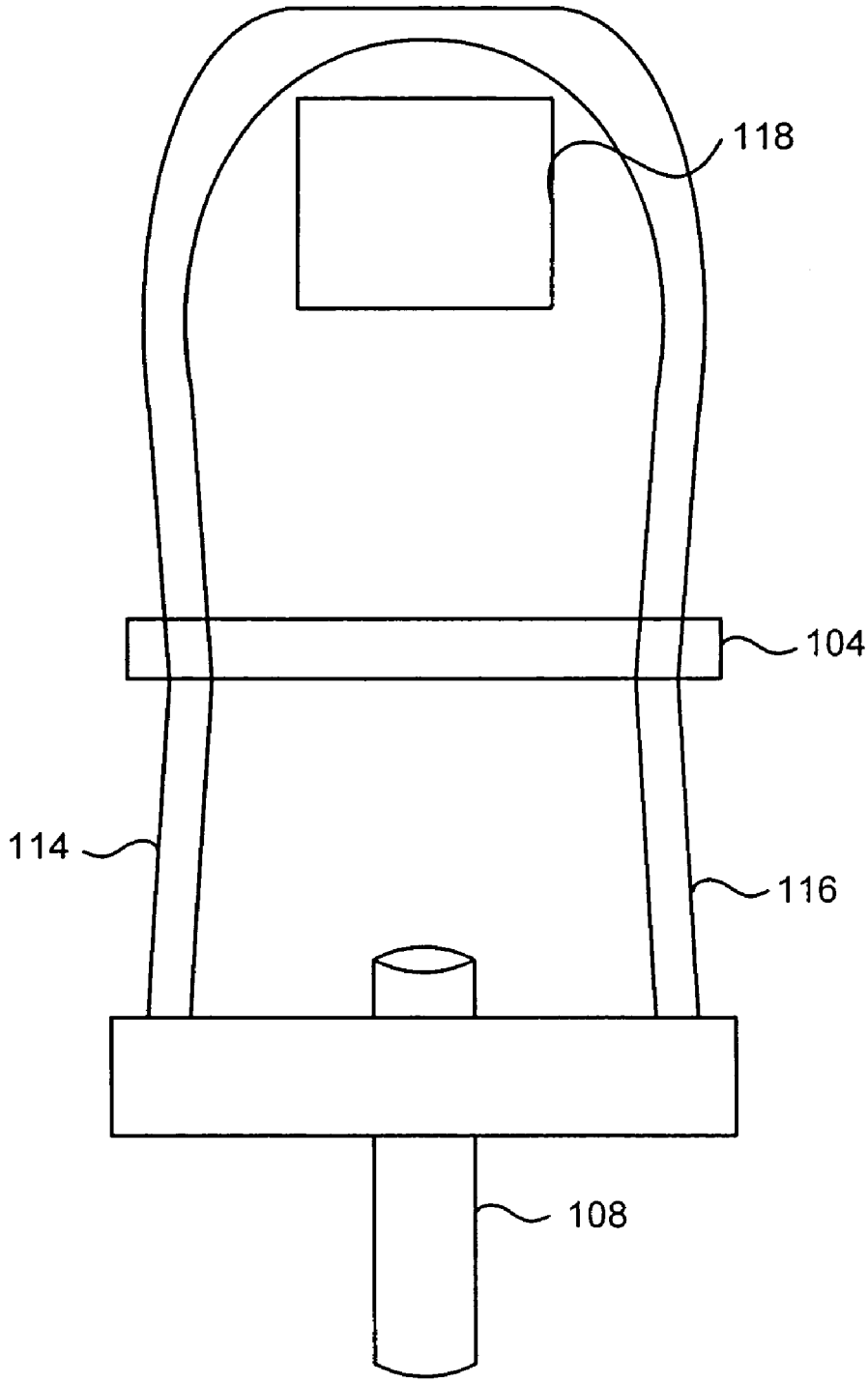
FIG. 1B illustrates in greater detail the point at which the monitoring device is attached to the pump.
Figure 1C:
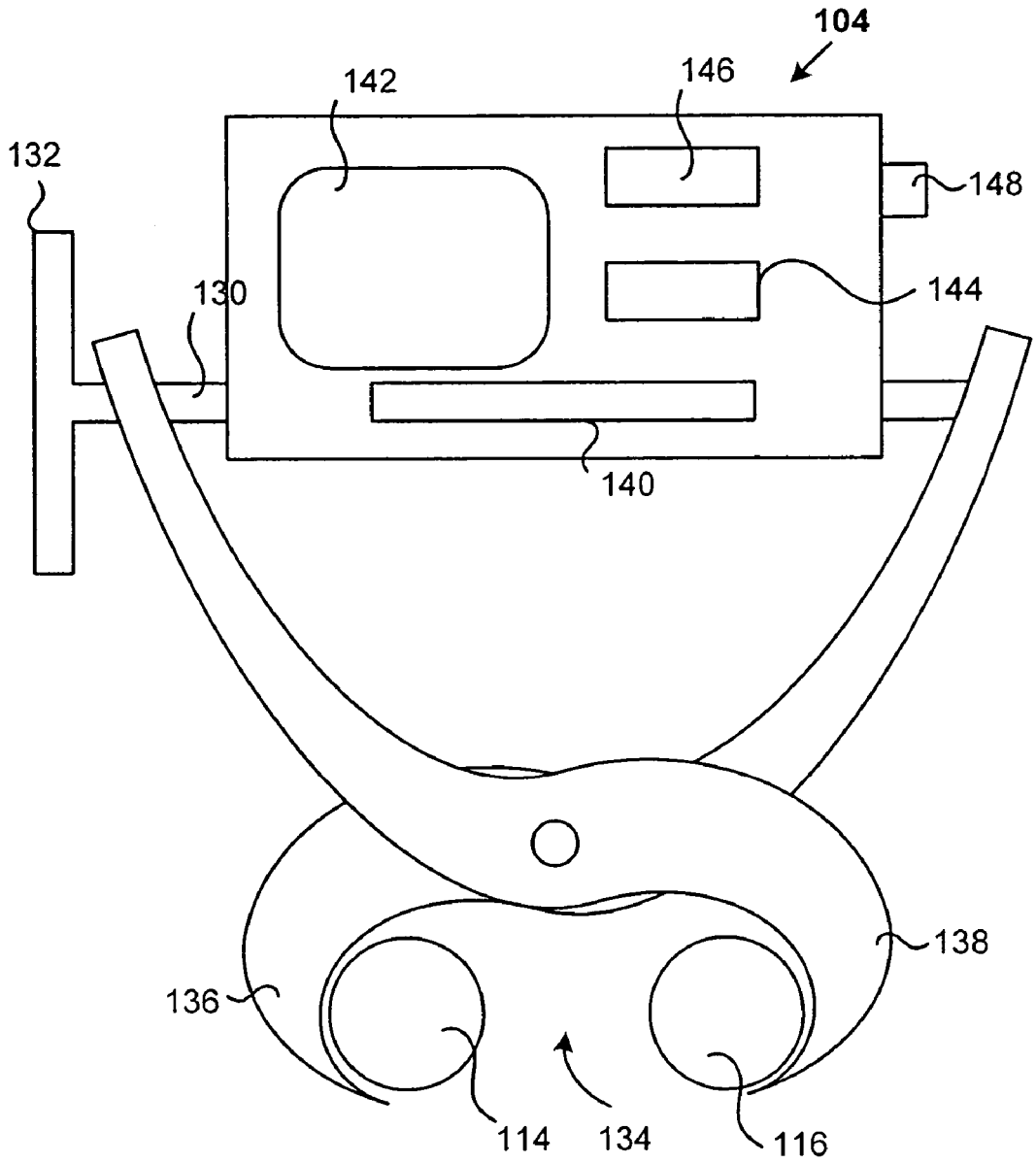
FIG. 1C illustrates the monitoring device in greater detail.

Having described embodiments of the present invention generally, attention is directed to FIGS. 1A to 1C, which illustrate a specific example of a beam pump system 100 according to embodiments of the invention. Those skilled in the art will appreciate that the system 100 is merely exemplary of a number of possible examples according to embodiments of the invention. The system 100 includes a beam pump 102, as is known in the art, and a beam pump dynamic loading monitoring device 104. The monitoring device 104 is attached to the cable harness 106 that connects the rod 108 to the horse head 110. FIG. 1B illustrates the region 112 in greater detail from a different perspective.

Referring to FIG. 1B, the cable harness 106 in this example includes two cables 114, 116 (or cable ends) that connect the rod 108 to an attachment point 118. The monitoring device 104 is connected across the cables 114, 116 such that the cables are slightly displaced inwardly. Thus, the monitoring device is positioned to measure the restoring force tending to return the cables 114, 116 to the non-displaced position. The force is generally proportional to the tension in the cables. FIG. 1C illustrates an embodiment of the monitoring device 104 in greater detail.

Referring to FIG. 1C, the monitoring device 104 includes an attachment mechanism, which in this example includes a threaded rod 130 and a tensioning knob 132 that together operate a scissor-like attachment having opposing members 136, 138. The cables 114, 116 are placed in the opening 134 and the tensioning knob 132 is tightened until the cables are slightly displaced inwardly. Thus, as the pump 102 operates, the device 104 measures the force tending to move the opposing members 136, 138 of the device 104 apart.

The force may be measured in any of a number of well known ways. In the specific example illustrated here, the force is measured using a strain gauge 140. The device is powered with a solar cell 142 and/or battery 144. The device also includes a transmitter 146 and antenna 148, which allow the device to be installed in remote locations and monitored via radio, satellite, cellular systems, and/or the like. The device 104 may be programmed to respond upon interrogation, to broadcast measurements periodically on a predetermined schedule, and/or the like. Further, the device may include a storage arrangement that allows the device to store measurements for later recall or transmission. Further still, the device may include an output screen that allows a user to directly access measurements. Many other possibilities exist and are apparent to those skilled in the art in light of this disclosure.

In some embodiments, the device also may be used to provide a feedback mechanism for the pump 102. For example, a motor controller 160 may be configured to receive measurements from the monitoring device 104 and adjust the pumping frequency accordingly. Thus, as the well draws down to the point that the pump rod loading exceeds a predetermined threshold, the motor controller 160 may decrease the pumping frequency. This allows the well more time to fill between pump strokes, thus improving pumping efficiency.

Figure 2:
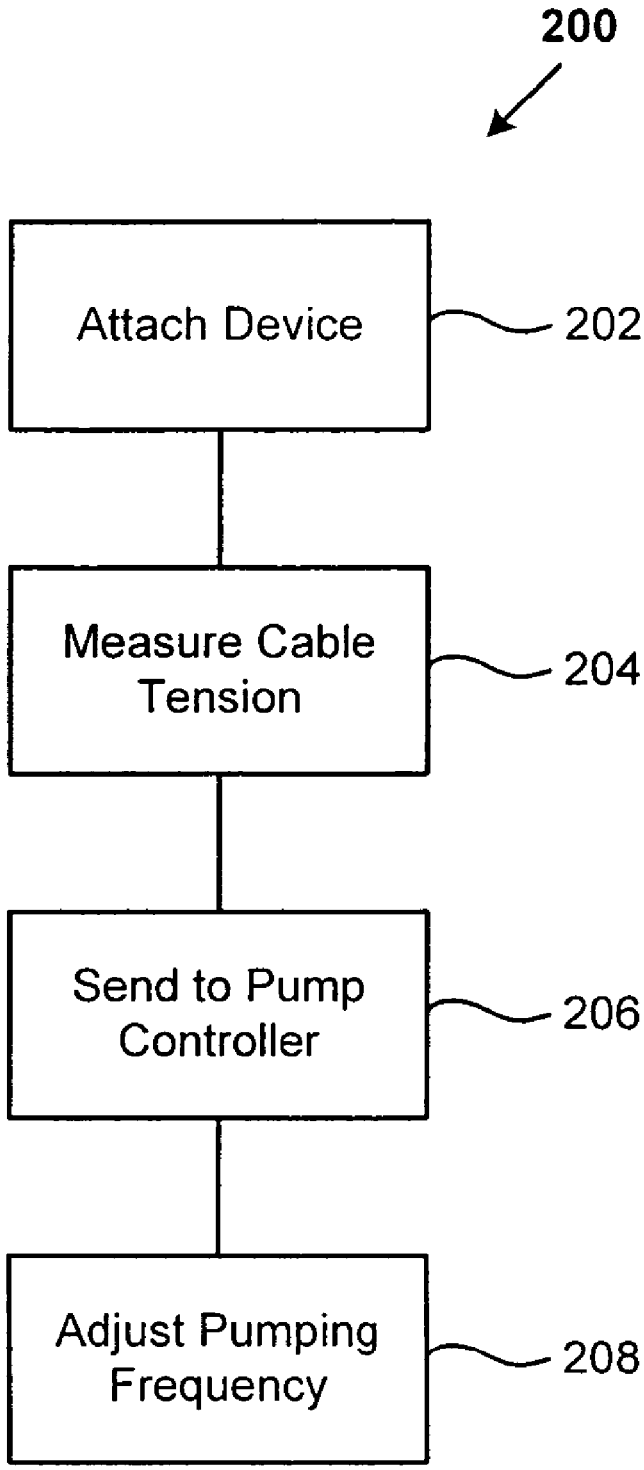
FIG. 2 illustrates a method of using a monitoring device to monitor beam pump dynamic loading according to embodiments of the invention.

Having generally described examples of a pump monitoring device according to embodiments of the invention, attention is directed to FIG. 2, which illustrates an example of a method 200 of using a monitoring device according to embodiments of the invention. The method may be used with respect to the system 100 of FIG. 1A or other suitable system. Those skilled in the art will appreciate that the method 200 is merely exemplary of a number of methods according to embodiments of the invention. Other embodiments may have more, fewer, or different operations than those illustrated and described here. Further, other embodiment may traverse the operations illustrated here in different orders, as will be appreciated by those skilled in the art in light of this disclosure.

The method 200 begins at block 202, at which point a monitoring device, such as the device 102, is attached to a cable harness of a beam pump. The device may be attached to the pump as described previously with respect to FIG. 1B. In some embodiments, the device may be attached to only a single cable.

At block 204, the device monitors the stress at the point at which the device is attached. In the specific embodiment described previously with respect to FIGS. 1A to 1C, the device measures the force tending to push outward on the opposing members 136, 138. In this embodiment, a strain gauge measures the force by measuring resistance changes as is known in the art. Other examples are possible.

At block 206, the measurement is sent to an external device, in this case, a pump controller. The transmission to the pump controller may be via wired or wireless connection. While in this example, the transmission is to a pump controller, the transmission in other embodiments may be to a monitoring location or the like. Other possibilities are apparent to those skilled in the art in light of this disclosure.

At block 208, the pump controller adjusts the pumping frequency based on the pump shaft loading measurement. Thus, as the load increases, the pumping frequency may be slowed to thereby allow sufficient time between pump strokes to allow material to flow into the well. Of course, the pumping frequency also may be increased in a similar manner when the pump rod loading is sufficiently low. This allows the pumping efficiency to be maintained within desirable parameters. Many other possibilities exist.

Having described several embodiments, it will be recognized by those of skill in the art that various modifications, alternative constructions, and equivalents may be used without departing from the spirit of the invention. Additionally, a number of well known processes and elements have not been described in order to avoid unnecessarily obscuring the present invention. For example, those skilled in the art know how to manufacture and assemble electrical devices and components. Accordingly, the above description should not be taken as limiting the scope of the invention, which is defined in the following claims.

What is claimed is:

1. A dynamic load monitoring system for a motor driven walking beam and cable harness actuated polished rod coupled in driving relationship with a down hole pump, comprising:

a monitoring device configured for attachment to the cable harness of such pump at a location above the polished rod effective to avoid monitoring error induced by thermal influence from the polished rod, the monitoring device having:

a strain gauge configured to be stressed in tension to measure dynamic loading of at least one cable of the cable harness as the pump operates; and a wireless transmitter configured to transmit the dynamic loading measurement; and an external device configured to receive the transmitted dynamic loading measurement.

2. The system of claim 1, wherein the external device comprises a monitoring location.

3. The system of claim 1, wherein the external device comprises a motor controller configured to adjust a pumping frequency of the pump in relation to the dynamic loading measurement.

4. The system of claim 1, wherein the monitoring device further comprises a solar cell configured to power the device.

5. The system of claim 1, wherein the monitoring device further comprises a battery configured to power the device.

6. The system of claim 1, wherein the monitoring device is configured for attachment between two cables of the cable harness at an attachment point at said location above the polished rod, such two cables being drawn together an amount effective to derive a tensile stress across the strain gauge representing a generally horizontal restoring force, tending to separate the cables from one another at the attachment point as the cables are tensioned in a generally vertical direction.

7. A monitoring device, comprising:

means for attaching the device to an attachment point of a cable harness of a walking beam pump such device being configured with a threaded member to engage and draw two cables of the cable harness together to derive a tension force to measure a generally horizontal restoring force tending to separate such cables from one another at the attachment point as the cables are tensioned in a generally vertical direction;

means including a strain gauge responsive in tension to said tension force for measuring dynamic loading of at least one cable of the cable harness as the pump operates;

means for powering the measuring means; and means for transmitting the dynamic loading measurement to a different location.

8. The monitoring device of claim 7, wherein the powering means comprises a solar cell.

9. The monitoring device of claim 7, wherein the powering means comprises a battery.

10. The monitoring device of claim 7, wherein the transmitting means comprises a wireless transmitter.

11. The monitoring device of claim 7, wherein the different location comprises a location proximate to a motor controller of the pump.

12. A method of monitoring dynamic loading in a walking beam pump, comprising:

attaching a monitoring device including a strain gauge to an attachment point of a cable harness connecting a polished rod to the pump, such attachment being made at a location above the polished rod effective to avoid monitoring error induced by thermal influence from the polished rod;

measuring the tensile stress in at least one cable of the cable harness induced at the attachment point by operation of the pump by stressing the strain gauge in tension; and transmitting the measurement to a different location.

13. The method of claim 12, wherein attaching a monitoring device to an attachment point of a cable harness comprises attaching the device to two cables of the cable harness, whereby the device is positioned to measure a horizontal restoring force tending to separate the cables from one another at the attachment point as the cables are tensioned in a generally vertical direction.

14. The method of claim 12, wherein attaching a monitoring device to an attachment point of a cable harness comprises attaching the device to a single cable of the cable harness.

15. The method of claim 12, wherein the different location comprises a location proximate to a motor controller of the pump, the method further comprising using the measurement to adjust a pumping frequency of the pump.

* * * * *